US011555333B2

(12) United States Patent
Wang

(10) Patent No.: US 11,555,333 B2
(45) Date of Patent: Jan. 17, 2023

(54) ELECTRONIC LOCK HAVING DISLOCATED TRANSMISSION MECHANISM INSIDE

(71) Applicant: JSW PACIFIC CORPORATION, New Taipei (TW)

(72) Inventor: Jang Yi Wang, New Taipei (TW)

(73) Assignee: JSW PACIFIC CORPORATION, New Taipei (TW)

( * ) Notice: Subject to any disclaimer, the term of this patent is extended or adjusted under 35 U.S.C. 154(b) by 394 days.

(21) Appl. No.: 16/860,115

(22) Filed: Apr. 28, 2020

(65) Prior Publication Data

US 2021/0332610 A1 Oct. 28, 2021

(51) Int. Cl.
*E05B 47/00* (2006.01)

(52) U.S. Cl.
CPC ..... *E05B 47/0012* (2013.01); *E05B 47/0001* (2013.01); *E05B 2047/002* (2013.01); *E05B 2047/0035* (2013.01)

(58) Field of Classification Search
CPC ..... E05B 47/0001; E05B 47/0012; E05B 2047/0017; E05B 2047/002; E05B 2047/0021; E05B 2047/0024; E05B 2047/0026; E05B 2047/0036; E05B 2047/0067; E05B 2047/0069; E05B 2047/0091; E05B 2045/065; E05B 2045/0655; E05B 2045/0685; E05B 2047/0035; Y10T 292/1021
See application file for complete search history.

(56) References Cited

U.S. PATENT DOCUMENTS

2013/0219975 A1* 8/2013 Ainley ..... E05B 47/026 70/279.1
2015/0191936 A1* 7/2015 Chen ..... E05B 47/0012 292/336.3
2019/0003207 A1* 1/2019 Wu ..... E05B 47/026
2019/0128021 A1* 5/2019 Notkin ..... E05B 47/0012

FOREIGN PATENT DOCUMENTS

EP 2083137 A1 * 7/2009 ..... E05B 13/101
SE 1550929 A1 * 1/2017
SE 1650221 A1 * 9/2017

* cited by examiner

*Primary Examiner* — Christine M Mills
*Assistant Examiner* — Christopher F Callahan
(74) *Attorney, Agent, or Firm* — Demian K. Jackson; Jackson IPG PLLC

(57) ABSTRACT

The present invention relates to an electronic lock. The electronic lock includes a turn piece coupled with a cylinder connecting spindle; an electric motor connected with a first bevel gear; and a dislocation transmission mechanism including a first dislocation member coupled with the turn piece and the cylinder connecting spindle and having an arc opening, and a second dislocation member engaged with the first bevel gear and having a protrusion, in which the protrusion is configured to extend into the arc opening, such that when the protrusion is engaged with either a first engaging portion or a second engaging portion at two ends of the arc opening, the first dislocation member is driven by the second dislocation member, and when the first dislocation member is in motion within a void range defined by the arc opening, the first dislocation member fails to drive the second dislocation member.

9 Claims, 7 Drawing Sheets

FIG. 4
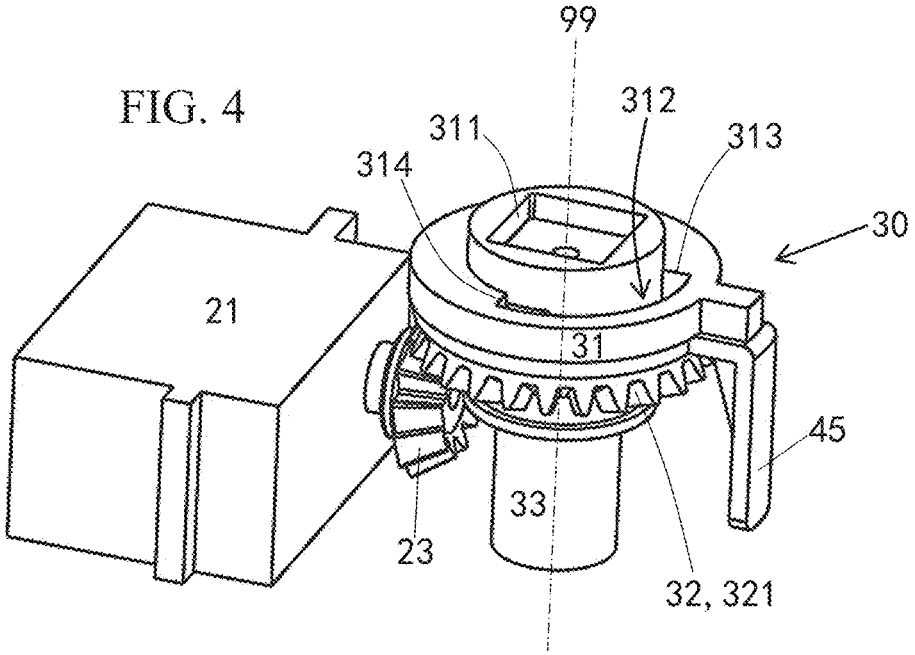
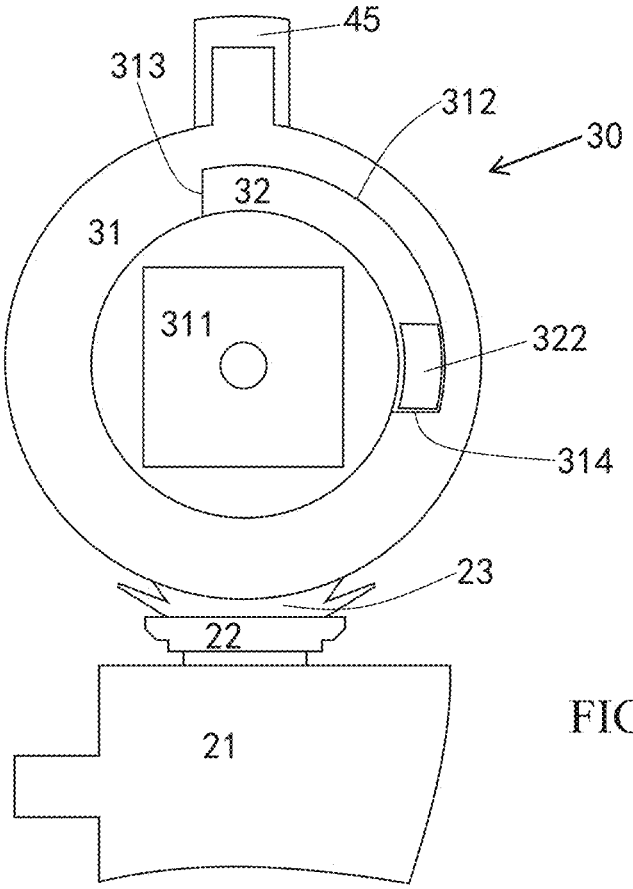
FIG. 5

ELECTRONIC LOCK HAVING DISLOCATED TRANSMISSION MECHANISM INSIDE

FIELD

The present invention relates to an electronic lock, in particular to an electronic lock configured with a dislocation transmission mechanism inside.

BACKGROUND

In recent years, more and more conventional locks have been redesigned and developed in a concept outside the square of traditional mechanics based structures to integrate with the cutting-edge technologies of electronics, network & communication and software. By a series of sophisticated designs, a variety of actuators, sensors, electronic components, communication modules and microcontroller chips are deployed and implanted into the mechanics based lockset, to form a mechanics-electronics hybrid lock termed as the electronic lock or the smart lock that various electronic components and multiple mechanical structures inside work collaboratively. Such an electronic lock provides not only a variety of operation modes that makes it more convenient to use, but also provides abundant novel functions, as well as is further capable of communicating, integrating and cooperating with peripheral electronic devices nearby to achieve a wider range of applications.

These electronic locks are especially widely applied in environments that highly demands full-time security, such as public and commercial buildings, compound housings and private residences. By the use of electronic locks, it allows users not only to manually operate with traditional keys from the outside, but also to use internal turn pieces to operate from the inside, as well as the use of passwords, electronic or biological identification to allow the electronic locks to determine whether an identification has rights to access or enter or not. In addition, it can record access information of each identification unit in detail in the internal data storage unit, and then provide for users to download data via wired or wireless connection, which is very convenient for use to control.

Although the electronic lock brings lot of conveniences for operations, it accepts users not only to lock or release from the external manually, but also to lock or release from the internal by a turn piece, or to operate locking or releasing by an electric motor disposed inside as long as a combination code, an electronic means, or a biometric identification is verified from the external. However, an issue is raised when a user locks or releases an electronic lock manually, that such a manual operation drives the electric motor inside the electronic lock to revolve reversely, which causes damages to the electric motor and transmission components or reduces the service life thereof.

Hence, there is a need to design and develop a mechanism configured inside the electronic lock to prevent the electric motor from revolving reversely during the period of manual operation, to protect the electric motor and the relevant transmission components, to solve the above deficiencies/issues exiting in the prior art.

SUMMARY

In order to prevent the electric motor from being revolved reversely occurring in the electronic lock during the period of manual operation, the present invention proposes to design and dispose a set of dislocation transmission mechanism inside the electronic lock, which is capable of preventing the electric motor inside from being revolved reversely occurring during the period of manual operation, so as to well protect the electric motor, gears involved in and related transmission members.

The present invention proposes to transmit the driving force from the turn piece, the cylinder connecting spindle, and the motor to the dislocation transmission mechanism first, which the dislocation transmission mechanism is selectively actuated between the engaged status and the disengaged status, to cause the turn piece and the cylinder connecting spindle to move in a dislocated motion, a void motion or a disengaged motion with respect to the electric motor, to protect the electric motor from being revolved reversely during manual operation, but at the same time to affect the normal manual or electric operation to the electronic lock.

The present invention provides an electronic lock which includes: a turn piece coupled with a cylinder connecting spindle; an electric motor connected with a first bevel gear; and a dislocation transmission mechanism including a first dislocation member coupled with the turn piece and the cylinder connecting spindle and having an arc opening, and a second dislocation member engaged with the first bevel gear and having a protrusion, in which the protrusion is configured to extend into the arc opening, such that when the protrusion is engaged with either a first engaging portion or a second engaging portion at two ends of the arc opening, the first dislocation member is driven by the second dislocation member, and when the first dislocation member is in motion within a void range defined by the arc opening, the first dislocation member fails to drive the second dislocation member.

Preferably, the electronic lock further includes: a lock status detecting module including a light mask moved with the first dislocation member and a plurality of optical coupler detecting slots detecting the light mask configured on a lock status detecting substrate, such that a direction of rotation, a current position, and a current angle of the first dislocation member are sensed by detecting the light mask by using the optical coupler detecting slots; and a micro controller unit commanding the electric motor based on the received direction of rotation, the current position, and the current angle.

Preferably, the first dislocation member further includes a dislocation shaft and a light block plate, in which the dislocation shaft is coupled with the cylinder connecting spindle, the turn piece, and the electric motor.

Preferably, the first dislocation member and the second are connected with each other in series along with the same rotary axis and in a coaxial and moveable configuration, in which the protrusion is extended into the arc opening from a direction substantively parallel to the rotary axis.

Preferably, when the first dislocation member is in motion within a void range between and defined by the first engaging portion and the second engaging portion, the second dislocation member remains still.

Preferably, when the second dislocation member is in motion within a void range between and defined by the first engaging portion and the second engaging portion, the first dislocation member remains still.

Preferably, when the first dislocation member is in motion within a void range defined by the arc opening, a driving force provided from the turn piece or the cylindrical connection spindle fails to drive the electric motor.

Preferably, when the second dislocation member further includes a second bevel gear engaged with the first bevel gear in an intersected-rotary-axis configuration, to transmit a driving force from the electric motor to the first dislocation member via either the first engaging portion or the second engaging portion.

Preferably, the arc opening is formed as a one-quarter arc aperture, a one-half arc aperture, a three-quarter arc aperture, or a C-shape arc aperture.

The present invention further provides an electronic lock which includes: a dislocation transmission mechanism including a first dislocation member having an arc opening, and a second dislocation member having a protrusion, in which the protrusion is configured to extend into the arc opening; a turn piece coupled with the first dislocation member and a cylinder connecting spindle; and an electric motor connected with a first bevel gear engaged with the second dislocation member, wherein when the protrusion is engaged with either a first engaging portion or a second engaging portion at two ends of the arc opening, the first dislocation member is driven by the second dislocation member, and when the first dislocation member is in motion within a void range defined by the arc opening, the first dislocation member fails to drive the second dislocation member.

DESCRIPTION OF THE DRAWINGS

A more complete appreciation in accordance with the present invention and many of the attendant advantages thereof are readily obtained as the same become better understood by reference to the following detailed description when considered in connection with the accompanying drawing, wherein:

FIG. 4 is a schematic diagram illustrating the perspective view of the structure for the dislocation transmission mechanism included in the electronic lock in accordance with the present invention;

FIG. 5 is a schematic diagram illustrating the top view of the structure for the dislocation transmission mechanism included in the electronic lock in accordance with the present invention;

DETAILED DESCRIPTION

Figure 1:
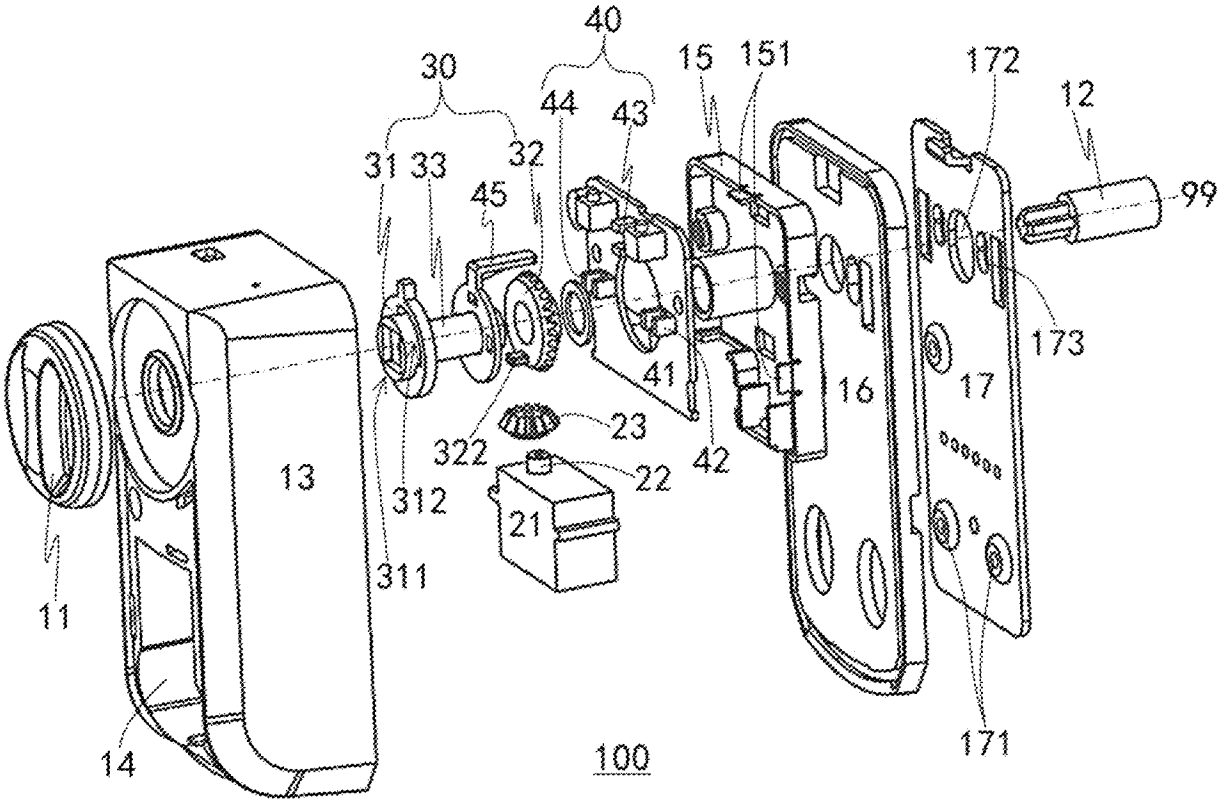
FIG. 1 is a schematic diagram illustrating the major exploded view of the overall structure for the electronic lock in accordance with the present invention.

The present disclosure will be described with respect to particular embodiments and with reference to certain drawings, but the disclosure is not limited thereto but is only limited by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice.

It is to be noticed that the term "including", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device including means A and B" should not be limited to devices consisting only of components A and B.

The disclosure will now be described by a detailed description of several embodiments. It is clear that other embodiments can be configured according to the knowledge of persons skilled in the art without departing from the true technical teaching of the present disclosure, the claimed disclosure being limited only by the terms of the appended claims.

The terms "locked" and "locked status" in the present disclosure are used as an adjective and a noun respectively and describe a static status of a lock, in general to describe the controlled lock tongue or latch bolt is moved or driven to an extended position and thus in an extended status. The terms "unlocked" and "unlocked status" in the present disclosure are used as an adjective and a noun respectively and describe a static status of a lock, in general to describe the controlled lock tongue or latch bolt is moved or driven to a retrieved position and thus in a retrieved status.

The terms "lock" and "locking" in the present disclosure are used as verbs and describe an action process the controlled lock tongue or latch bolt is moved to travel from a retrieved position to an extended position. The terms "release" and "releasing" in the present disclosure are used as verbs and describe an action process the controlled lock tongue or latch bolt is moved to travel from an extended position to a retrieved position. The term "coupled" in the present disclosure is used to describe that two separated components are connected with each other in direct connection or in indirect connection, in which the indirect connection means that the two separated components are connected with each other through a third component or multiple components.

Figure 2:
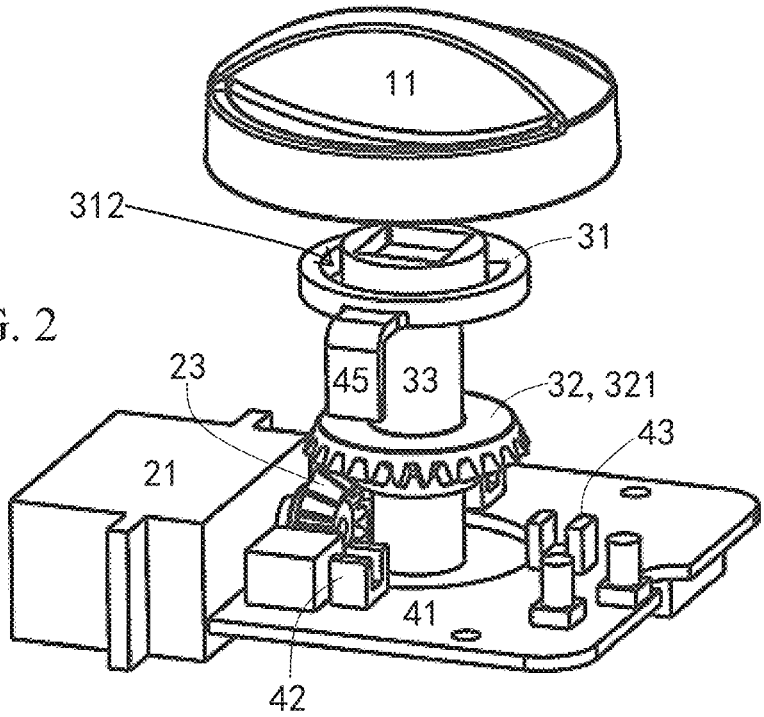
FIG. 2 is a schematic diagram illustrating the perspective view of the structure for components arranged surrounding the rotary axis inside the electronic lock in accordance with the present invention.
Figure 3:
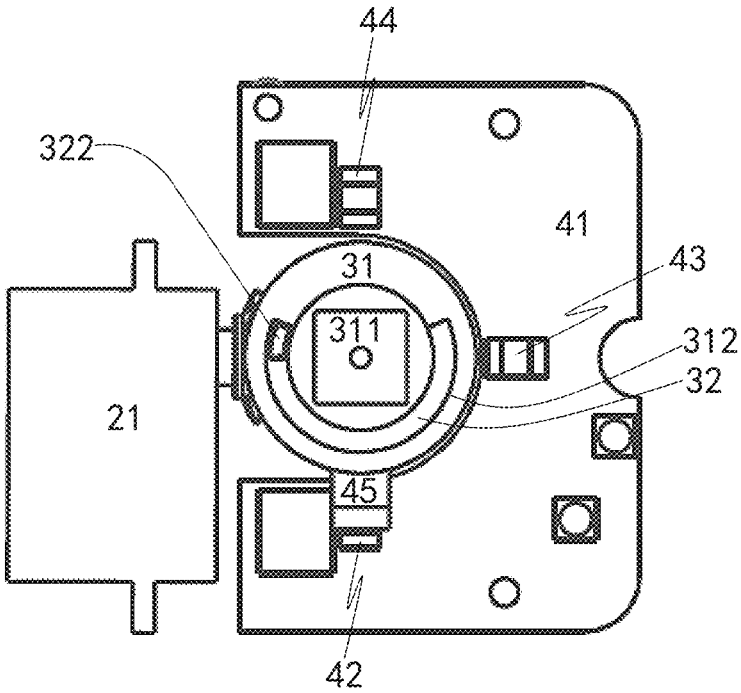
FIG. 3 is a schematic diagram illustrating the top view of the structure for components arranged surrounding the rotary axis inside the electronic lock in accordance with the present invention.

FIG. 1 is a schematic diagram illustrating the major exploded view of the overall structure for the electronic lock in accordance with the present invention; FIG. 2 is a schematic diagram illustrating the perspective view of the structure for components arranged surrounding the rotary axis inside the electronic lock in accordance with the present invention; and FIG. 3 is a schematic diagram illustrating the top view of the structure for components arranged surrounding the rotary axis inside the electronic lock in accordance with the present invention. The electronic lock 100 in accordance with the present invention is preferably composed of an electric-electronic component and a mechanical structure, and installed in the interior side of the door to provide for a user with an option to manually operate the turn piece 11, such as: the knob, to drive the latch bolt or lock tongue in the lock cylinder to the extended position or the retrieved position, so as to cause the lock cylinder into a locked or unlocked status, respectively; or provide a user, after identification verification, with the option to hand over to the motor inside the lock body to drive the latch bolt to the extended position or the retrieved position, and render the lock cylinder entering a locked or unlocked status, respectively. A turning key is no longer required to operate during the aforementioned locking and unlocking processes.

The back plate 17 of the electronic lock 100 is locked on the inside of the door piece through a screw hole 171 with, for example but not limited to, a self-tapping screw, and is protruded outside the door piece. A cylinder connecting spindle 12 interlocking with the latch bolt can be exposed from the lock cylinder opening 172 on the back plate 17. A virtual rotary axis 99 is extended along the central axis of the cylinder connecting spindle 12. With the rotary axis 99 as a reference, a first dislocation member 31 and a dislocated transmission shaft 33 are positioned on the casing 13 through a base (not shown) formed on the inner side of the casing 13. The turn piece 11 is connected to the dislocated transmission shaft 33 through a rectangular interface 311 on the dislocated transmission shaft 33. The dislocated transmission shaft 33 is connected to the cylinder connecting spindle 12, and the cylinder connecting spindle 12 is linked with the latch bolt and driven by the turn piece 11, capable of moving the latch bolt to the extended or retrieved position. The turn piece 11 is assembled in a rotatable manner and exposed outside the casing 13 to provide a user with manual operation.

The cylinder connecting spindle 12 can preferably be an original cylinder spindle, that is, the existing spindle installed on the door piece and protruding outside the door piece. The type of the lock cylinder can be, for example but not limited to, a deadbolt lock or a mortise lock, or the cylinder connecting spindle 12 can be another spindle installed on the door piece in advance and linked with the existing cylinder spindle. It is worth noting that the original lock can be retained on the outside of the door piece, so the user can insert the key from the outside to turn the lock cylinder, and at the same time to drive the rotation of the cylinder connecting spindle 12. Alternatively, the outside of the door piece can install an exterior-side electronic lock module exclusive for exterior-side use through the technologies such as, but not limited to, password identification technology, electronic induction identification technology, or biometric identification technology, etc. for user identification and verification. After confirming the right to operate, the motor 21 will perform locking or unlocking.

A battery holder 14 is also formed on the casing 13 in order to accommodate a battery pack for supplying power to the motor 21. A plurality of sets of wire assembly holes 173 are arranged on the back plate 17 for passing through the power supply line. The motor 21 is positioned on the casing 13 through a motor base (not shown) inside the casing 13. The output shaft 22 of the motor 21 is directly connected to a bevel gear (driving gear) 23, and the bevel gear is directly engaged with another second dislocation member (driven gear) 32, whose body is also a bevel gear having a larger number of teeth. In this way, the driving force generated by the motor 21 is transmitted through a set of two bevel gears with intersecting shaft configuration. By the disposition of the bevel gears with intersecting shaft configuration, the space for gear configuration is minimized to save space. In particular, the configuration of the intersecting shaft bevel gear allows each bevel gear to have a large tooth, so it can withstand a larger positive stress, suitable for transmitting the high torque generated by the motor 21, providing a high transmission efficiency of 98%-99%, and indirectly increasing the service life of the gear. In this embodiment, the tooth ratio between the bevel gear 23 and the second dislocation member 32 is preferably 1:2, so each engagement can have multiple teeth engaged, which is suitable for transmission with large torque.

The interior of the electronic lock in accordance with the present invention also includes a set of dislocation transmission mechanism 30, mainly including a first dislocation member 31, a second dislocation member 32, and a dislocated transmission shaft 33, etc. An arc opening 312 is formed on the first dislocation member 31, and a protrusion 322 is formed on the second dislocation member 32. The second dislocation member 32 is rotatably sleeved on the dislocated transmission shaft 33. The second dislocation member 32, the first dislocation member 31, and the dislocated transmission shaft 33 are coaxially connected along the rotary axis 99 in a movable or floating manner, and arranged in parallel along the rotary axis 99. Therefore, the arc opening 312 and the protrusion 322 are arranged side by side and correspond to each other. The protrusion 322 can extend into the arc opening 312 in the direction parallel to the rotary axis 99. After assembly, the protrusion 322 will remain to extend into the arc opening 312.

The interior of the electronic lock in accordance with the present invention also includes a set of lock-status sensing modules 40, which is mainly disposed on a lock-status sensing substrate 41. An optical coupler detection slot 42, an optical coupler detection slot 43, and an optical coupler detection slot 44 are respectively disposed on the right side, in the center, and on the left side of the lock-status sensing substrate 41. A set of optical baffles 45 is optionally arranged between the first dislocation member 31 and the second dislocation member 32, and the optical baffles 45 are synchronously linked with the dislocated transmission shaft 33. If the lock-status sensing substrate 41 is so configured that when the dislocated transmission shaft 33 rotates clockwise, the optical baffle 45 is aligned and revolved into the right-side optical coupler detection slot 42. Conversely, when the dislocated transmission shaft 33 rotates counterclockwise, the optical baffle 45 can be aligned and revolved into the left-side optical coupler detection slot 44, so that the microcontroller (MCU) on the internal control circuit board (not shown) of the electronic lock 100 detects the current positions of the first dislocation member 31 and the dislocated transmission shaft 33 by receiving the detection signals of the optical coupler detection slots 42, 43 and 44. In this way, the MCU provides the user with the conditions of setting up the left or right door opening as well as setting up a forward locking mode or a reverse locking mode in the installation stage of the electronic lock 100.

When the first dislocation member 31, the second dislocation member 32, the dislocated transmission shaft 33, the optical baffle 45, and the lock-status sensing substrate 41 are assembled and positioned on the casing 13, a set of inner members 15 is covered on the outer side of the lock-status sensing substrate 41. A tenon 151 on the inner member 15 is engaged with the slot on the casing 13 to fix the first dislocation member 31 and other components, or a screw is selectively passed through the screw hole on the inner member 15 and the lock-status sensing substrate 41 to lock these components on the casing 13. When the motor 21, the bevel gear 23 and the control circuit board containing the MCU are assembled and positioned on the casing 13, a rubber gasket 16 is arranged between the inner member 15 and the back plate 17, and then the casing 13 is locked to the back plate 17.

The electronic lock 100 in accordance with the present invention can permit the user to manually perform the locking or unlocking from the interior side of the door with the turn piece 11, or permit the user, after passing the user identification verification, to order the internal motor 21 to perform the locking or unlocking from the interior side of the door, or permit the user, after passing the password, electronic induction or biological characteristics, to command the internal motor 21 to perform the locking or unlocking from the exterior side of the door, or permit the user to insert a key into the lock from the exterior side of the door to manually perform the locking or unlocking. Therefore, it is inevitable that under certain operating conditions, manual operation will lead to the reverse rotation of the motor. In order to avoid the reverse rotation of the motor 21 caused by manual operation, the electronic lock 100 in accordance with the present invention is internally equipped with a set of dislocation transmission mechanism 30, which can avoid the reversal of motor 21 caused by manual operation under certain operating conditions, and play a good role in protecting the motor 21.

FIG. 4 is a schematic diagram illustrating the perspective view of the structure for the dislocation transmission mechanism included in the electronic lock in accordance with the present invention; and FIG. 5 is a schematic diagram illustrating the top view of the structure for the dislocation transmission mechanism included in the electronic lock in accordance with the present invention. The electronic lock 100 in accordance with the present invention internally includes a set of dislocation transmission mechanisms 30. The dislocation transmission mechanism 30 includes a first dislocation member 31, a second dislocation member 32, and a dislocated transmission shaft 33. The first dislocation member 31 is connected to the dislocated transmission shaft 33, or the first dislocation member 31 and the dislocated transmission shaft 33 are preferably made by integral molding or separately made as independent components and then combined with, for example but not limited to, screws, welding or engaging methods. The first dislocation member 31 is basically a disc body in structure, and at least one rectangular interface 311 and one arc opening 312 or an arc slot are formed on the first dislocation member 31. The shape of the arc opening 312 is preferably a ¼ (quarter) arc, a ½ (two quarters) arc, a ¾ (three quarters) arc, as shown in FIG. 5, or a C-shaped arc as shown in the arc opening 312 of FIG. 3. The two ends of the arc opening 312 have a first engaging portion 313 and a second engaging portion 314, respectively.

The second dislocation member 32 roughly corresponds to the first dislocation member 31 in shape, and is also roughly a disc body in structure. The second dislocation member 32 includes a bevel gear 321 or the body itself is a bevel gear 321, and the second dislocation member 32 meshes with the bevel gear 23 connected to the output shaft 22 of the motor 21. A protrusion 322 is also formed on the second dislocation member 32. The second dislocation member 32 is sleeved into the dislocated transmission shaft 33 in a rotatable or floating manner After assembly, the centers of the first dislocation member 31 and the second dislocation member 32 are essentially on the rotary axis 99, or the centers of the first dislocation member 31 and the second dislocation member 32 are essentially assembled in a coaxial manner. The arc opening 312 of the first dislocation member 31 and the protrusion 322 of the second dislocation member 32 correspond to each other in position. After assembly, the protrusion 322 can extend into the arc opening 312, and move freely between the first engaging portion 313 and the second engaging portion 314. Therefore, when the second dislocation member 32 moves within the actuation region defined by the arc opening 312, the first dislocation member 31 is not driven to move. On the contrary, when the first dislocation member 31 moves within the actuation region defined by the arc opening 312, the second dislocation member 32 is not driven to move. In this embodiment, an additional set of optical baffles 45 can be selectively arranged between the first dislocation member 31 and the second dislocation member 32.

Figure 6:
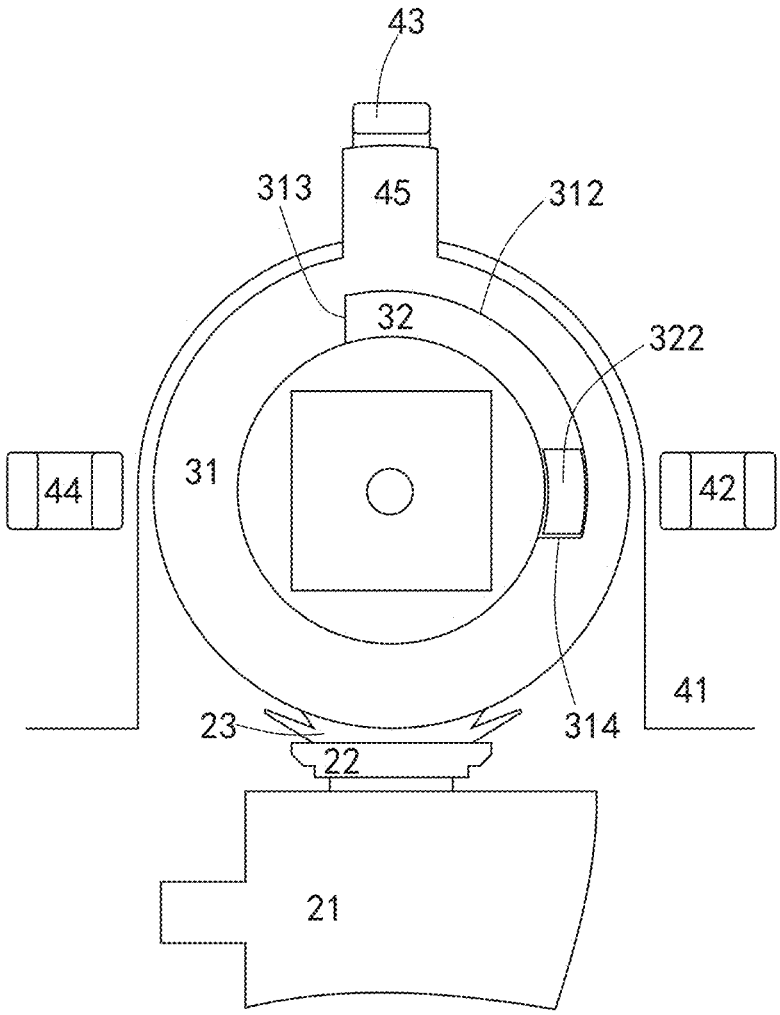
FIG. 6 is a schematic diagram illustrating the structure in the first status for the dislocation transmission mechanism included in the electronic lock in accordance with the present invention.
Figure 7:
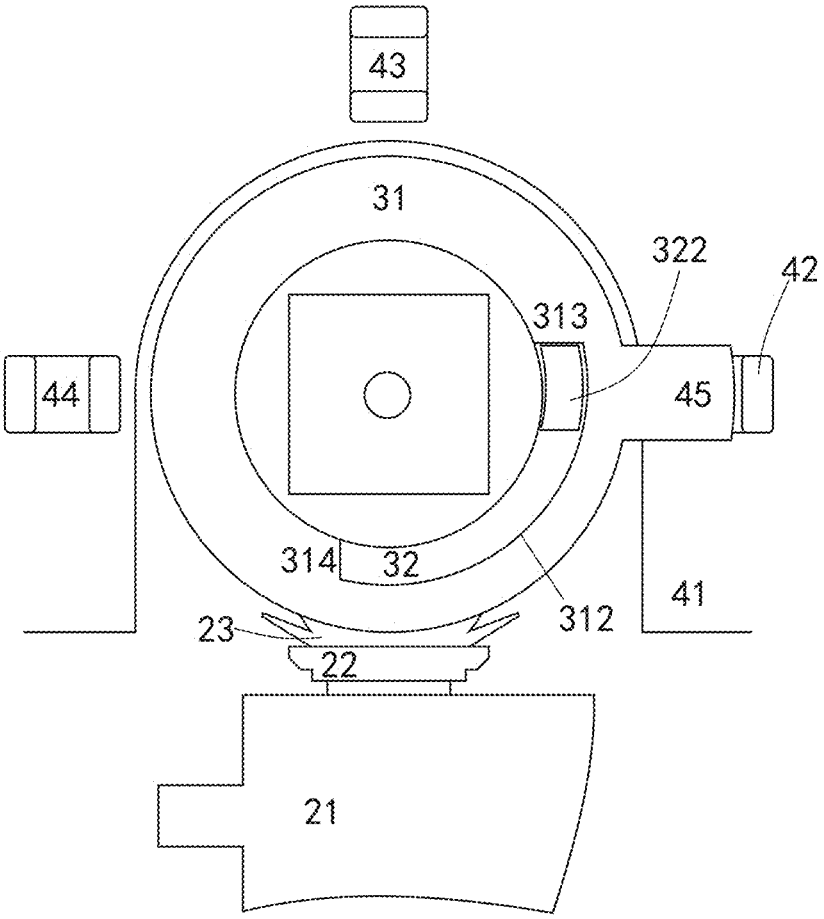
FIG. 7 is a schematic diagram illustrating the structure in the second status for the dislocation transmission mechanism included in the electronic lock in accordance with the present invention.

FIG. 6 is a schematic diagram illustrating the structure in the first status for the dislocation transmission mechanism included in the electronic lock in accordance with the present invention; and FIG. 7 is a schematic diagram illustrating the structure in the second status for the dislocation transmission mechanism included in the electronic lock in accordance with the present invention. In this embodiment, the optical baffle 45 is directly formed on the first dislocation member 31, and an optical coupler detection slot 42, an optical coupler detection slot 43, and an optical coupler detection slot 44 are respectively provided on the right side, in the center, and on the left side of the lock-status sensing substrate 41. The MCU inside the electronic lock 100 can sense the information such as the current position of the first dislocation member 31 and the dislocated transmission shaft 33.

For example, if a user wants to manually lock the lock cylinder and if the protrusion 322 is stopped at a position close to the second engaging portion 314, representing a first status shown in FIG. 6, when the electronic lock 100 receives the manual locking operation from the user, it may be a manual locking operation by turning the turn piece 11 on the electronic lock 100, or it may be a manual locking operation by turning the key from the exterior side of the door. The user turns the key toward the locking direction, for example but not limited to, the clockwise rotation direction. At this time, the driving force generated by the manual operation is transmitted through the turn piece 11 or through the cylinder connecting spindle 12 to first drive the dislocated transmission shaft 33 and then the first dislocation member 31 to generate corresponding rotation synchronously. When the rotation direction of the first dislocation member 31 is to drive the second engaging portion 314 away from the protrusion 322, and to drive the first engaging portion 313 to approach the protrusion 322, since protrusion 322 moves in the hollow region of the arc opening 312, no engagement motion occurs between the second dislocation member 32 and the first dislocation member 31, instead in a disengagement status. Therefore, during the rotation of the first dislocation member 31, the second dislocation member 32 does not rotate with the first dislocation member 31 and remains stationary, so the bevel gear 23 connected to the output shaft 22 of the motor 21 will not reverse or idle by the user's manual locking operation. When the lock cylinder is designed for 90-degree locking, the arc opening 312 moves clockwise by a ¼ of arc stroke, and will halt when the first engaging portion 313 reaches the vicinity of the protrusion 322. In the process, the second dislocation member 32 can be kept in a stationary status, representing a second status shown in FIG. 7, and the lock cylinder enters the locked status. The detection signal returned by the optical coupler detection slot 42 on the right side can further confirm the lock cylinder indeed in the locked status.

When a user performs a manual unlocking operation, the user turns the key toward the unlocking direction, for example but not limited to, the counterclockwise rotation direction. At this time, the driving force generated by the manual operation, as shown in FIG. 7, is transmitted through the turn piece 11 or through the cylinder connecting spindle 12 to first drive the first dislocation member 31 and then the dislocated transmission shaft 33 to generate corresponding rotation synchronously. When the rotation direction of the first dislocation member 31 is to drive the first engaging portion 313 away from the protrusion 322 and approach the second engaging portion 314, since protrusion 322 still moves in the hollow region of the arc opening 312, the second dislocation member 32 and the first dislocation member 31 are still in a disengagement status. Therefore, during the rotation of the first dislocation member 31, the second dislocation member 32 does not rotate with the first dislocation member 31 and remains stationary, so the bevel gear 23 connected to the output shaft 22 of the motor 21 will not reverse or idle by the user's manual unlocking operation. When the lock cylinder is designed for 90-degree unlocking, the arc opening 312 moves counterclockwise by a ¼ of arc stroke, and will halt when the second engaging portion 314 reaches the vicinity of the protrusion 322. In the process, the second dislocation member 32 can be kept in a stationary status, returning to the first status shown in FIG. 6, and the lock cylinder enters the unlocked status. The detection signal returned by the optical coupler detection slot 43 in the center can further confirm the lock cylinder indeed in the unlocked status.

Figure 8:
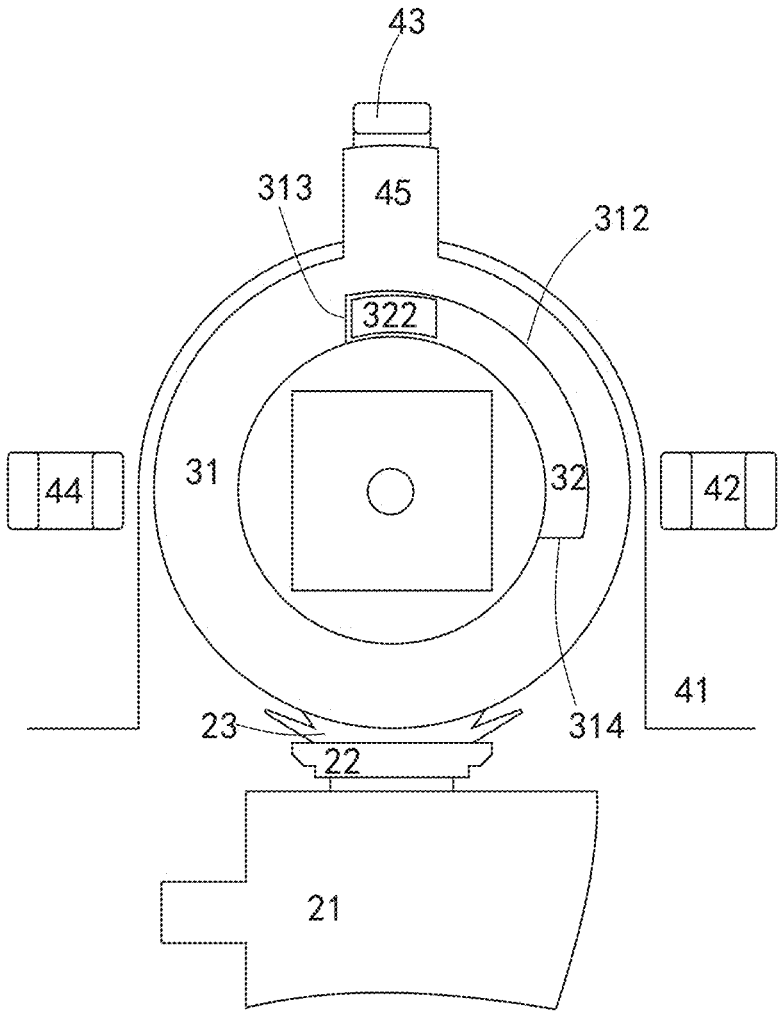
FIG. 8 is a schematic diagram illustrating the structure in the third status for the dislocation transmission mechanism included in the electronic lock in accordance with the present invention.

FIG. 8 is a schematic diagram illustrating the structure in the third status for the dislocation transmission mechanism included in the electronic lock in accordance with the present invention. After locking up a lock by hand, a user wants to let the motor 21 inside the lock body perform the electric unlocking operation. After the user passes the identification verification from the exterior side or interior side of the door, the MCU commands the motor 21 to turn the lock cylinder toward the unlocking direction, for example but not limited to, the clockwise rotation direction. At this time, the driving force generated by the rotation of the output shaft 22, as shown in FIG. 7, is transmitted through the bevel gear 23 to drive the second dislocation member 32 to perform corresponding rotation. Because of the rotation direction of the second dislocation member 32, the protrusion 322 and the first engaging portion 313 are driven to generate mesh and enter the engagement status, so the first dislocation member 31 and the dislocated transmission shaft 33 are driven to generate the corresponding rotation synchronously, and the dislocated transmission shaft 33 further drives the cylinder connecting spindle 12. When the lock cylinder is designed for 90-degree unlocking, the motor 21 drives the protrusion 322 to move counterclockwise by a ¼ of arc stroke and will halt, representing a third status shown in FIG. 8, and the lock cylinder enters the unlocked status. The detection signal returned by the optical coupler detection slot 43 in the center can further confirm the lock cylinder indeed in the unlocked status.

Figure 9:
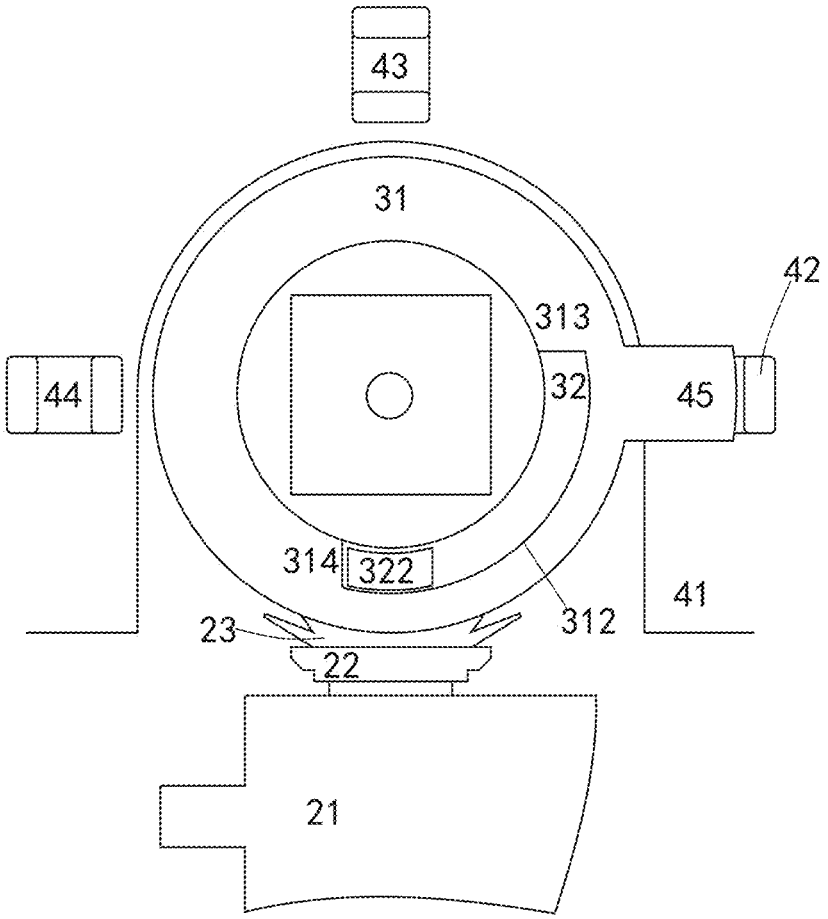
FIG. 9 is a schematic diagram illustrating the structure in the fourth status for the dislocation transmission mechanism included in the electronic lock in accordance with the present invention.

FIG. 9 is a schematic diagram illustrating the structure in the fourth status for the dislocation transmission mechanism included in the electronic lock in accordance with the present invention. For example, when a user wants to let the motor 21 inside the lock body perform the electric locking operation, no matter the user passes the identification verification from the exterior side or interior side of the door or no matter the protrusion 322 is close to the first engaging portion 313 or the second engaging portion 314, if the protrusion 322 is close to the first engaging portion 313 as shown in FIG. 8, the MCU will command the motor 21 to turn the lock cylinder toward the locking direction, for example but not limited to, the clockwise rotation direction. When the lock cylinder is designed for 90-degree locking, through the detection signal sent back to the MCU by the optical coupler detection slot 43 in the center, the MCU has sensed that the dislocated transmission shaft 33 or the first dislocation member 31 is in the center position, thereby confirming the correct position of the arc opening 312. Since the position of the protrusion 322 can be correctly grasped by the MCU, when the MCU confirms that the arc opening 312 and the protrusion 322 are in the third status as shown in FIG. 8, the MCU commands the motor 21 to turn the lock cylinder twice as much as the locking angle toward the locking direction. When the lock cylinder is designed for 90-degree unlocking, the MCU commands the motor 21 to rotate 180 degrees, and the driving force generated by the rotation of the motor 21 is transmitted by the bevel gear 23 to drive the second dislocation member 32 to rotate clockwise. At this time, the rotation direction of the second dislocation member 32 will eventually cause the protrusion 322 and the second engaging portion 314 to engage with each other, so the first dislocation member 31 and the dislocated transmission shaft 33 will be driven to rotate synchronously. The dislocated transmission shaft 33 further drives the cylinder connecting spindle 12 to the fourth status as shown in FIG. 9, and the lock cylinder enters the locked status. The detection signal returned by the optical coupler detection slot 42 on the right side can further confirm the lock cylinder indeed in the locked status.

When a user wants to let the motor 21 inside the lock body perform the electric unlocking operation, after the user passes the identification verification, the motor 21 will turn the lock cylinder toward the unlocking direction, for example but not limited to, the counterclockwise rotation direction. When the lock cylinder is designed for 90-degree unlocking, through the perception of the MCU, the MCU commands the motor 21 to rotate 180 degrees towards the unlocking direction, and the driving force generated by the rotation of the motor 21, as shown in FIG. 9, is transmitted through the bevel gear 23 to drive the second dislocation member 32 to rotate counterclockwise. At this time, the rotation direction of the second dislocation member 32 will eventually drive the protrusion 322 to engage with the first engaging portion 313, so it will drive the first dislocation member 31 and the dislocated transmission shaft 33 to generate corresponding rotation. The dislocated transmission shaft 33 further drives the cylinder connecting spindle 12 to return to the third status as shown in FIG. 8, and the lock cylinder enters the unlocked status. The detection signal returned by the optical coupler detection slot 43 in the center can further confirm the lock cylinder indeed in the unlocked status.

Therefore, the electronic lock 100 proposed by the present invention is configured with a set of dislocation transmission mechanism 30 and a lock-status sensing modules 40 between the turn piece 11, the cylinder connecting spindle 12, and the motor 21 with respect to the lock cylinder or the cylinder connecting spindle 12 to transmit the driving force from the turn piece 11, the cylinder connecting spindle 12, and the motor 21 to the dislocation transmission mechanism 30 first. Through the arrangement of the dislocation transmission mechanism 30 and the timely adjustment of the lock-status sensing modules 40, the first dislocation member 31 and the second dislocation member 32 is selectively actuated between the engaged status and the disengaged status under different conditions to generate an engagement and disengagement motion, an engaged motion, a disengaged motion, a void motion or a dislocation motion, so as to achieve the function of protecting the motor 21 from being reversed during the manual operation. It protects the motor 21, relevant gear set and transmission parts, etc., but at the same time, it does not affect the normal manual or electric operation of the electronic lock 100.

There are further embodiments provided as follows.

Embodiment 1: An electronic lock includes: a turn piece coupled with a cylinder connecting spindle; an electric motor connected with a first bevel gear; and a dislocation transmission mechanism including a first dislocation member coupled with the turn piece and the cylinder connecting spindle and having an arc opening, and a second dislocation member engaged with the first bevel gear and having a protrusion, in which the protrusion is configured to extend into the arc opening, such that when the protrusion is engaged with either a first engaging portion or a second engaging portion at two ends of the arc opening, the first dislocation member is driven by the second dislocation member, and when the first dislocation member is in motion within a void range defined by the arc opening, the first dislocation member fails to drive the second dislocation member.

Embodiment 2: The electronic lock as described in Embodiment 1, further includes: a lock status detecting module including a light mask moved with the first dislocation member and a plurality of optical coupler detecting slots detecting the light mask configured on a lock status detecting substrate, such that a direction of rotation, a current position, and a current angle of the first dislocation member are sensed by detecting the light mask by using the optical coupler detecting slots; and a micro controller unit commanding the electric motor based on the received direction of rotation, the current position, and the current angle.

Embodiment 3: The electronic lock as described in Embodiment 1, the first dislocation member further includes a dislocation shaft and a light block plate, in which the dislocation shaft is coupled with the cylinder connecting spindle, the turn piece, and the electric motor.

Embodiment 4: The electronic lock as described in Embodiment 1, the first dislocation member and the second are connected with each other in series along with the same rotary axis and in a coaxial and moveable configuration, in which the protrusion is extended into the arc opening from a direction substantively parallel to the rotary axis.

Embodiment 5: The electronic lock as described in Embodiment 1, when the first dislocation member is in motion within a void range between and defined by the first engaging portion and the second engaging portion, the second dislocation member remains still.

Embodiment 6: The electronic lock as described in Embodiment 1, when the second dislocation member is in motion within a void range between and defined by the first engaging portion and the second engaging portion, the first dislocation member remains still.

Embodiment 7: The electronic lock as described in Embodiment 1, when the first dislocation member is in motion within a void range defined by the arc opening, a driving force provided from the turn piece or the cylindrical connection spindle fails to drive the electric motor.

Embodiment 8: The electronic lock as described in Embodiment 1, when the second dislocation member further includes a second bevel gear engaged with the first bevel gear in an intersected-rotary-axis configuration, to transmit a driving force from the electric motor to the first dislocation member via either the first engaging portion or the second engaging portion.

Embodiment 9: The electronic lock as described in Embodiment 1, the arc opening is formed as a one-quarter arc aperture, a one-half arc aperture, a three-quarter arc aperture, or a C-shape arc aperture.

Embodiment 10: An electronic lock includes: a dislocation transmission mechanism including a first dislocation member having an arc opening, and a second dislocation member having a protrusion, in which the protrusion is configured to extend into the arc opening; a turn piece coupled with the first dislocation member and a cylinder connecting spindle; and an electric motor connected with a first bevel gear engaged with the second dislocation member, wherein when the protrusion is engaged with either a first engaging portion or a second engaging portion at two ends of the arc opening, the first dislocation member is driven by the second dislocation member, and when the first dislocation member is in motion within a void range defined by the arc opening, the first dislocation member fails to drive the second dislocation member.

While the disclosure has been described in terms of what are presently considered to be the most practical and preferred embodiments, it is to be understood that the disclosure need not be limited to the disclosed embodiments. On the contrary, it is intended to cover various modifications and similar arrangements included within the spirit and scope of the appended claims, which are to be accorded with the broadest interpretation so as to encompass all such modifications and similar structures. Therefore, the above description and illustration should not be taken as limiting the scope of the present disclosure which is defined by the appended claims.

What is claimed is:

1. An electronic lock, comprising:

a turn piece coupled with a cylinder connecting spindle;

an electric motor connected with a first bevel gear; and a dislocation transmission mechanism comprising a first dislocation member coupled with the turn piece and the cylinder connecting spindle and having an arc opening, and a second dislocation member engaged with the first bevel gear and having a protrusion, in which the protrusion is configured to extend into the arc opening, such that when the protrusion is engaged with either a first engaging portion or a second engaging portion at two ends of the arc opening, the first dislocation member is driven by the second dislocation member, and when the first dislocation member is in motion within a void range defined by the arc opening, the first dislocation member fails to drive the second dislocation member, wherein the second dislocation member further comprises a second bevel gear engaged with the first bevel gear in an intersected-rotary-axis configuration, to transmit a driving force from the electric motor to the first dislocation member via either the first engaging portion or the second engaging portion.

2. The electronic lock as claimed in claim 1, further comprising:

a lock status detecting module comprising a light mask moved with the first dislocation member and a plurality of optical coupler detecting slots detecting the light mask configured on a lock status detecting substrate, such that a direction of rotation, a current position, and a current angle of the first dislocation member are sensed by detecting the light mask by using the optical coupler detecting slots; and a micro controller unit commanding the electric motor based on the received direction of rotation, the current position, and the current angle.

3. The electronic lock as claimed in claim 1, wherein the first dislocation member further comprises a dislocation shaft and a light block plate, in which the dislocation shaft is coupled with the cylinder connecting spindle, the turn piece, and the electric motor.

4. The electronic lock as claimed in claim 1, wherein the first dislocation member and the second are connected with each other in series along with the same rotary axis and in a coaxial and moveable configuration, in which the protrusion is extended into the arc opening from a direction substantively parallel to the rotary axis.

5. The electronic lock as claimed in claim 1, wherein the first dislocation member is configured to be moved within the void range between and defined by the first engaging portion and the second engaging portion, during which the second dislocation member remains still.

6. The electronic lock as claimed in claim 1, wherein the first dislocation member is configured to be moved within the void range defined by the arc opening, during which a driving force provided from the turn piece or the cylindrical connection spindle fails to drive the electric motor.

7. The electronic lock as claimed in claim 1, wherein the arc opening is formed as a one-quarter arc aperture, a one-half arc aperture, a three-quarter arc aperture, or a C-shape arc aperture.

8. The electronic lock as claimed in claim 1, wherein when the second dislocation member is in motion within a void range between and defined by the first engaging portion and the second engaging portion, the first dislocation member remains still.

9. An electronic lock, comprising:

a dislocation transmission mechanism comprising a first dislocation member having an arc opening, and a second dislocation member having a protrusion, in which the protrusion is configured to extend into the arc opening;

a turn piece coupled with the first dislocation member and a cylinder connecting spindle; and an electric motor connected with a first bevel gear engaged with the second dislocation member, wherein when the protrusion is engaged with either a first engaging portion or a second engaging portion at two ends of the arc opening, the first dislocation member is driven by the second dislocation member, and when the first dislocation member is in motion within a void range defined by the arc opening, the first dislocation member fails to drive the second dislocation member, wherein the second dislocation member further comprises a second bevel gear engaged with the first bevel gear in an intersected-rotary-axis configuration, to transmit a driving force from the electric motor to the first dislocation member via either the first engaging portion or the second engaging portion.

* * * * *